US006646217B2

(12) United States Patent
Omata

(10) Patent No.: US 6,646,217 B2
(45) Date of Patent: Nov. 11, 2003

(54) TACTILE SWITCH

(75) Inventor: Kazuki Omata, Yamanashi-ken (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 0 days.

(21) Appl. No.: 10/054,939

(22) Filed: Jan. 25, 2002

(65) Prior Publication Data

US 2002/0104749 A1 Aug. 8, 2002

(30) Foreign Application Priority Data

Feb. 7, 2001 (JP) ..... 2001-031618

(51) Int. Cl.[7] ..... H01H 5/18
(52) U.S. Cl. ..... 200/406; 200/409; 200/5 A
(58) Field of Search ..... 200/406, 409, 200/412, 468, 512, 513, 5 A, 333, 402; 338/47, 114, 97

(56) References Cited

U.S. PATENT DOCUMENTS

| | | | | | |
|---|---|---|---|---|---|
| 3,973,091 | A | * | 8/1976 | Kaminski | 200/5 A |
| 4,778,952 | A | * | 10/1988 | Watkins et al. | 200/5 A |
| 5,510,584 | A | * | 4/1996 | Norris | 200/5 A |
| 5,898,147 | A | * | 4/1999 | Domzalski et al. | 200/1 B |
| 6,067,005 | A | * | 5/2000 | DeVolpi | 338/47 |
| 6,133,536 | A | * | 10/2000 | Hunag et al. | 200/5 A |
| 6,518,527 | B2 | * | 2/2003 | Watanabe et al. | 200/406 |
| 6,552,287 | B2 | * | 4/2003 | Janniere | 200/406 |

* cited by examiner

*Primary Examiner*—Elvin Enad
*Assistant Examiner*—K. Lee
(74) *Attorney, Agent, or Firm*—Dennison, Schultz & Dougherty

(57) ABSTRACT

An annular first fixed contact is provided on a substrate, and a second fixed contact is provided on the substrate within the first fixed contact. A spherical spring contact having legs is mounted on the first fixed contact by the legs.

4 Claims, 6 Drawing Sheets

TACTILE SWITCH

BACKGROUND OF THE INVENTION

The present invention relates to a tactile switch used in a portable telephone, portable radio receiver, camera and others.

FIG. 6 is a plan view showing a conventional tactile switch, FIG. 7 is a sectional view taken along a line VII—VII of FIG. 6, FIG. 8 is a bottom view of the tactile switch and FIG. 9 is a plan view showing a substrate 1.

The tactile switch has a side of 4 mm and a thickness of 0.5 mm. The switch has a substrate 1, a first fixed contact 5 secured to the substrate 1, a spring contact 4 mounted on the first fixed contact 5 and a flexible cover 3 made of plastic and secured to the substrate 1 through a spacer 2 so as to provide a watertight sealing.

The spring contact 4 has a semispherical shape and is surrounded by a wall of a circular hole 2*a* of the spacer 2. Each of four corners of the substrate has a semicircular recess. As shown in FIG. 8, four terminal electrodes 9*a* to 9*d* are secured to the underside of the substrate 1 at the four corners in order to connect the tactile switch with an instrument to be mounted therein. Each of the terminal electrodes 9*a* to 9*d* is connected to a conductive pattern on the substrate 1 through a lead provided on the semicircular recess.

As shown in FIGS. 7 and 9, the first fixed contact 5 is provided on a peripheral portion of the substrate to form a circular vacancy, and connected to the terminal electrode 9*a* through the lead on the semicircular recess. The spring contact 4 is contacted with the first fixed contact 5 at the peripheral edge thereof.

A second fixed contact 6 is securely mounted on the underside of the substrate 1 at a central portion of the circular vacancy. The second fixed contact 6 is connected to the terminal electrode 9*c* by a lead provided in a through-hole 7 and a conductive pattern 8.

The spring contact 4 is depressed through the cover 3 by a push button provided in the instrument, so that a central portion of the spring contact 4 is downwardly bent. When the spring contact 4 passes a neutral point, the spring contact quickly inverts. Thus, the spring contact contacts with the second fixed contact 6, so that the first fixed contact 5 is connected to the second fixed contact 6.

Such a tactile switch must endure a large number of operations. For example, the tactile switch mounted in the portable telephone must endure over 500,000 operations. For the long life, stainless steel is used for the spring contact. However, the stiffness of the spring contact is liable to be extremely high, because the size of the spring contact is very small. As a result, the spring contact strikes hard against the second fixed contact, thereby producing harsh noises.

In addition, the through-hole 7 causes the manufacturing cost of the tactile switch to increase.

SUMMARY OF THE INVENTION

An object of the present invention is to provide a tactile switch which is simple in construction, excellent in function, and has a long life and high reliability.

According to the present invention, there is provided a tactile switch comprising a substrate, an annular first fixed contact provided on the substrate, a second fixed contact provided on the substrate within the first fixed contact, a spherical spring contact having legs contacted with the first fixed contact.

Each of the legs contacts with the first fixed contact at a peripheral edge thereof.

An arc portion is formed between adjacent legs.

The second fixed contact is connected to a terminal electrode by a conductive pattern passing through a passage formed in the first fixed contact and a space formed under the arc portion.

These and other objects and features of the present invention will become more apparent from the following detailed description with reference to the accompanying drawings.

DETAILED DESCRIPTION OF THE PREFERRED EMBODIMENT

Figure 1:
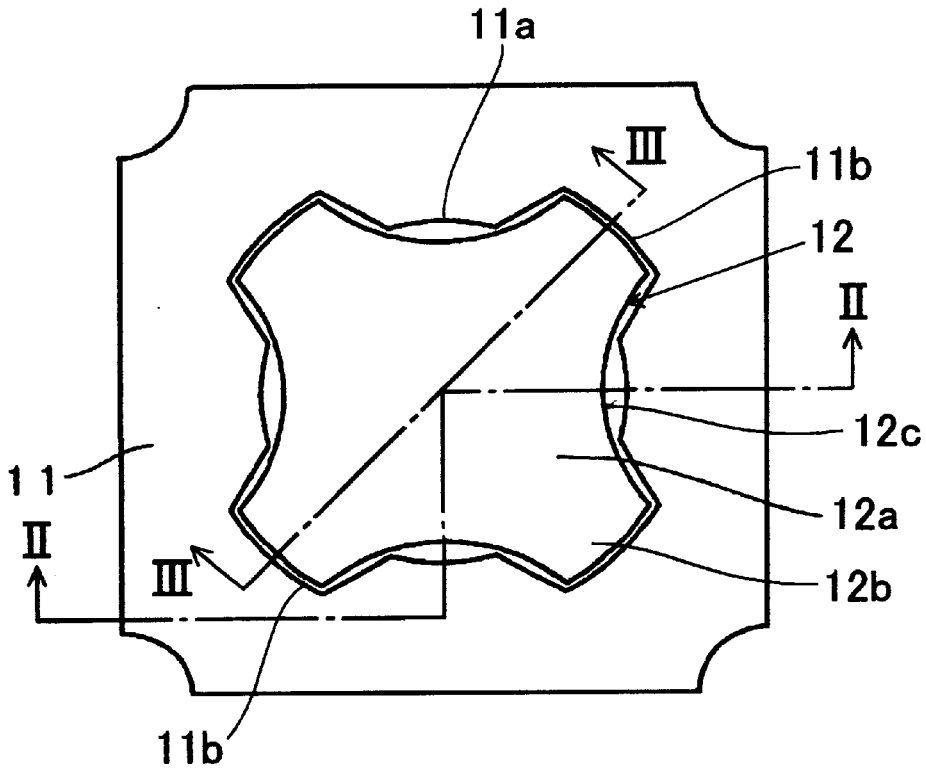
FIG. 1 is a plan view of a tactile switch of the present invention.
Figure 2:
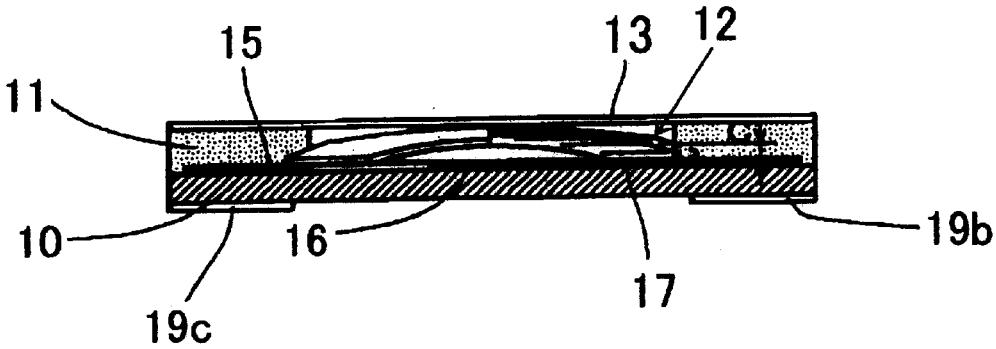
FIG. 2 is a sectional view taken along a line II—II of FIG. 1.

Referring to FIGS. 1 and 2, the tactile switch has a substrate 10, an annular first fixed contact 15 secured to the substrate 10, a second fixed contact 16 provided at a central portion of the substrate 10, a spring contact 12, a flexible cover 13 made of plastic and secured to the substrate 10 through a spacer 11 so as to provide a watertight sealing, and terminal electrodes 19*a* to 19*d* at four corners.

Figure 3:
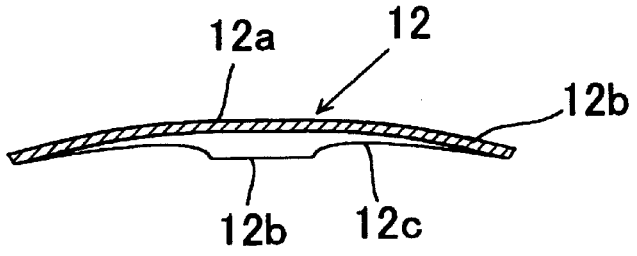
FIG. 3 is a sectional view taken along a line III—III of FIG. 1.
Figure 4:
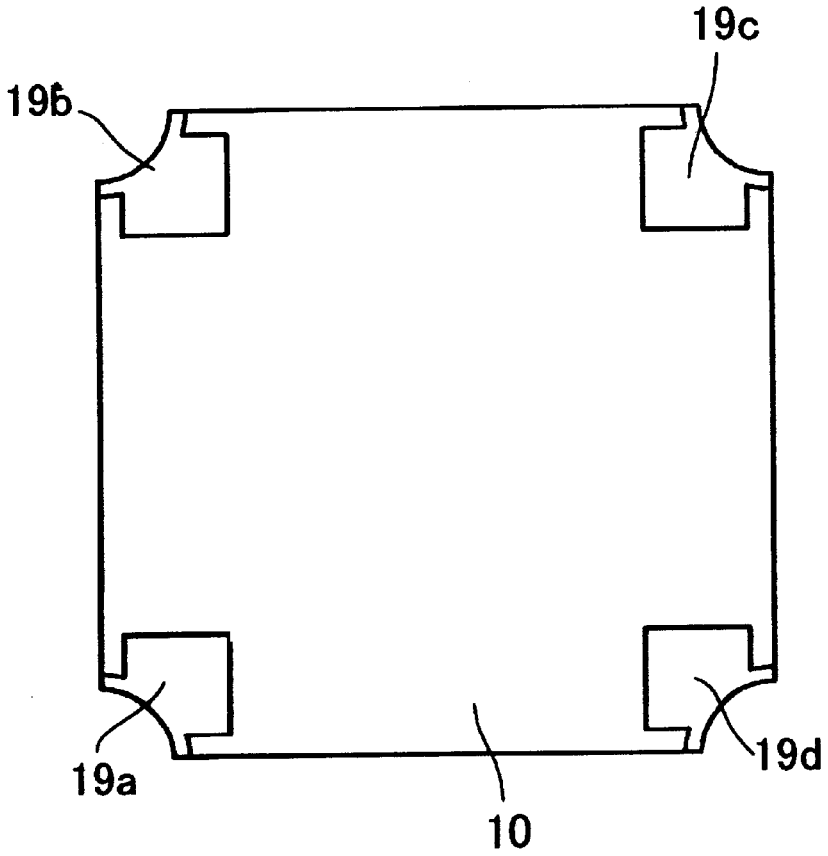
FIG. 4 is a bottom view of the tactile switch.

The spring contact 12 has a substantially cross shape in plan view as shown in FIG. 1, and hence comprises a central spherical body 12*a* and four legs 12*b*. As shown in FIG. 3, the spherical body 12*a* and the legs 12*b* are continuously curved, and an arc portion 12*c* is formed between the legs 12*b*. Each of the legs 12*b* is engaged with the first fixed contact 15 at a peripheral edge thereof.

As shown in FIG. 1, a hole 11*a* of the spacer 11 has four recesses 11*b* in which legs 12*b* of the spring contact 12 are engaged so as to prevent the spring contact from rotating.

Figure 5:
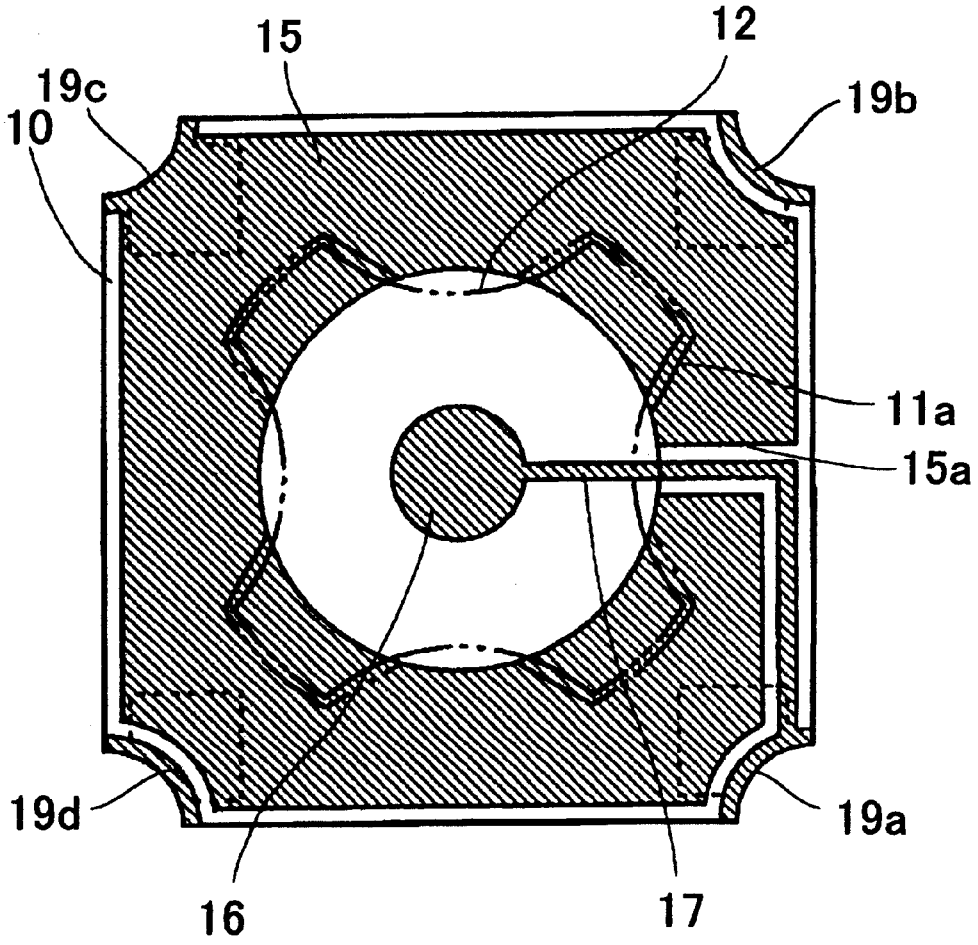
FIG. 5 is a plan view of a substrate.
Figure 6:
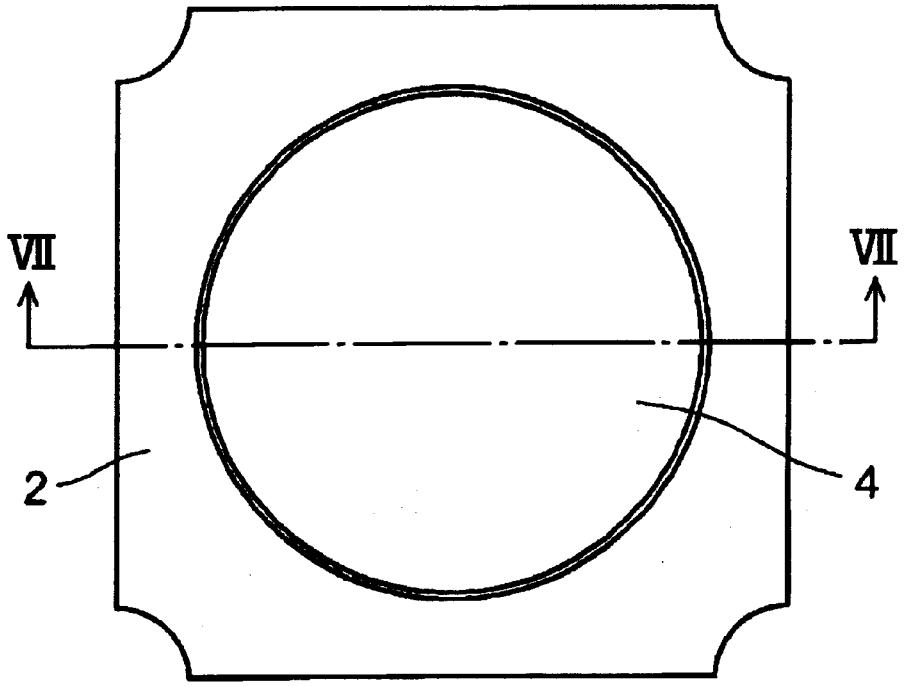
FIG. 6 PRIOR ART
FIG. 6 is a plan view showing a conventional tactile switch.
Figure 7:
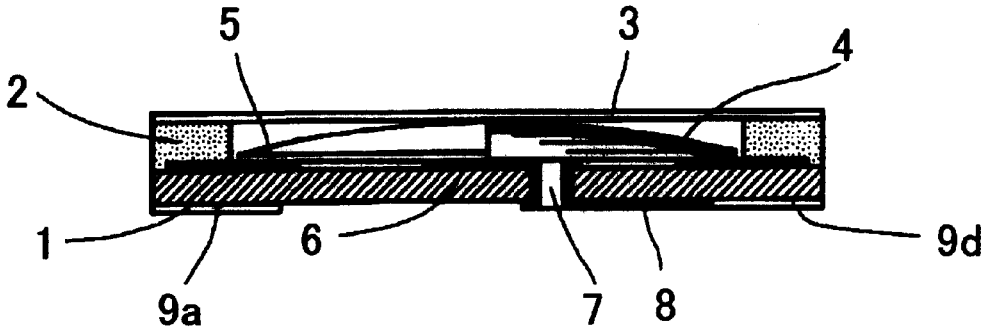
FIG. 7 PRIOR ART
FIG. 7 is a sectional view taken along a line VII—VII of FIG. 6.
Figure 8:
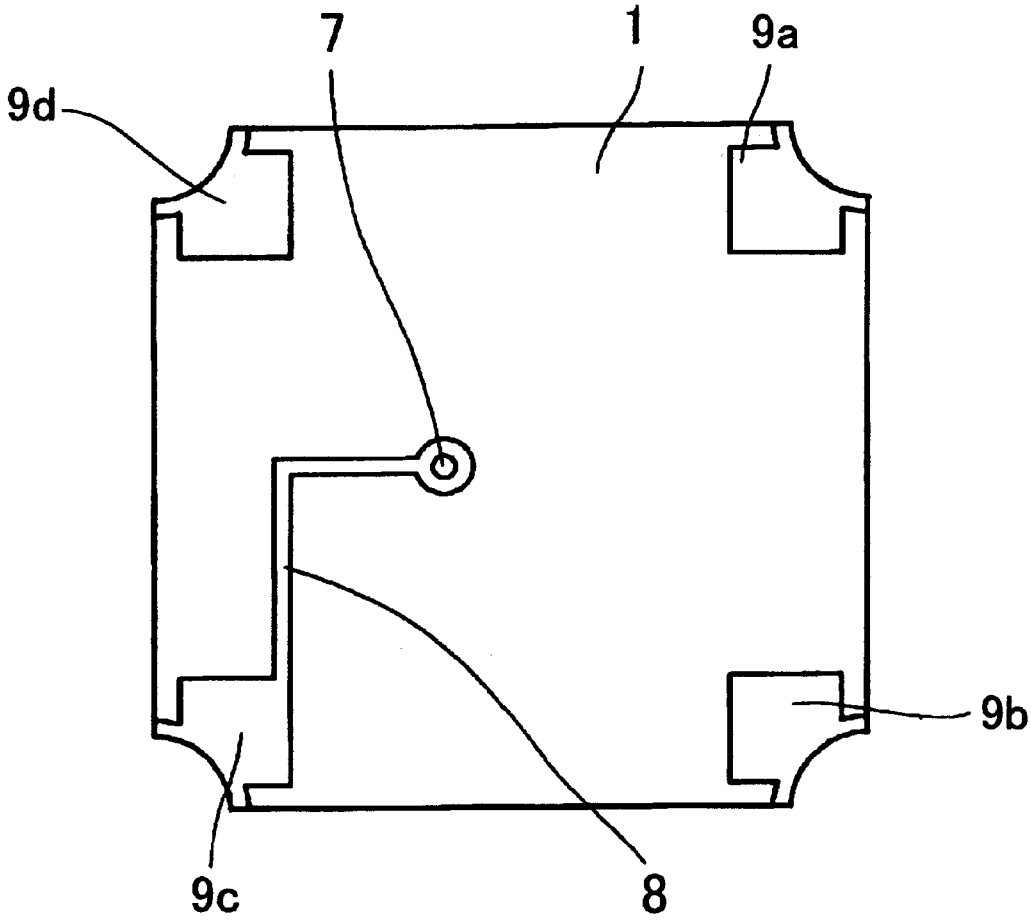
FIG. 8 PRIOR ART
FIG. 8 is a bottom view of the tactile switch;-.
Figure 9:
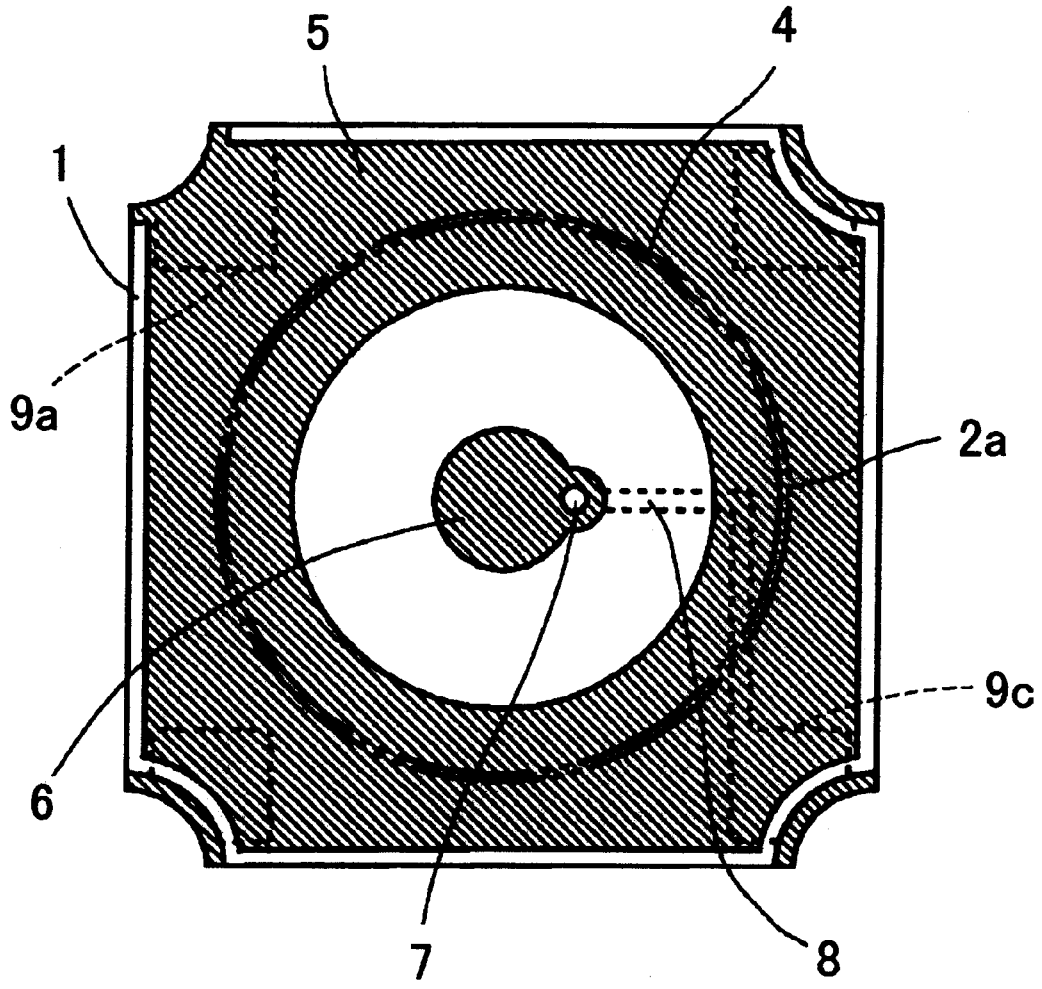
FIG. 9 PRIOR ART
FIG. 9 is a plan view showing a substrate.

Referring to FIG. 5, the first fixed contact 15 has a passage 15*a*, and the second fixed contact 16 is connected to the terminal electrode 19*a* by a conductive pattern 17, passing through the passage 15*a* and a space c (FIG. 2) under the arc portion 12*c*. The first fixed contact 15 is connected to the terminal electrode 19*c*.

When the spring contact 4 of the prior art is depressed at the central portion, the central portion is bent in an inverted spherical shape so that a stress generated at the circular peripheral edge concentrates in the central portion. Consequently, large impact sounds generate.

In the spring contact 12 of the present invention, stresses generated at the legs 12*b* transmit also to the arc portions 12*c*, so that concentration of the stress at the central portion reduces. Thus, impact sounds decrease.

Furthermore, in accordance with the present invention, since a through-hole is not provided in the substrate, the construction of the switch becomes simple and manufacturing cost reduces.

While the invention has been described in conjunction with preferred specific embodiment thereof, it will be understood that this description is intended to illustrate and not limit the scope of the invention, which is defined by the following claims.

What is claimed is:

1. A tactile switch comprising, substrate having an upper side and an underside;

an annular first fixed contact provided on the upper side of the substrate;

a second fixed contact provided on the upper side of the substrate within the first fixed contact;

an angular spacer mounted on the upper side of the substrate and the first fixed contact;

a spherical spring contact having legs contacted with the first fixed contact, each of the legs being engaged with a recess formed in the spacer; and terminal electrodes provided on the underside of the substrate;

wherein the second fixed contact is connected to one of the terminal electrodes by a conductive pattern passing through a passage formed in the first fixed contact and a space formed between the legs.

2. The tactile switch according to claim 1 wherein each of the legs contacts with the first fixed contact at a peripheral edge thereof.

3. The tactile switch according to claim 1 wherein an arc portion is formed between adjacent legs.

4. The tactile switch according to claim 3 wherein the space is formed under the arc portion.

* * * * *